US008979549B2

(12) United States Patent
Lin

(10) Patent No.: US 8,979,549 B2
(45) Date of Patent: Mar. 17, 2015

(54) ROTATING PLUG

(71) Applicant: Kuei-Yang Lin, Taipei (TW)

(72) Inventor: Kuei-Yang Lin, Taipei (TW)

( * ) Notice: Subject to any disclaimer, the term of this patent is extended or adjusted under 35 U.S.C. 154(b) by 63 days.

(21) Appl. No.: 13/961,977

(22) Filed: Aug. 8, 2013

(65) Prior Publication Data

US 2015/0044884 A1 Feb. 12, 2015

(51) Int. Cl.
*H01R 39/00* (2006.01)
*H01R 13/46* (2006.01)

(52) U.S. Cl.
CPC ..... *H01R 13/46* (2013.01)
USPC ..... 439/31

(58) Field of Classification Search
CPC ..... H01R 35/04
USPC ..... 439/11, 31
See application file for complete search history.

(56) References Cited

U.S. PATENT DOCUMENTS

| | | | | | |
|---|---|---|---|---|---|
| 861,468 | A * | 7/1907 | Kreinsen | 439/11 |
| 2,305,101 | A * | 12/1942 | O'Brien | 439/4 |
| 2,511,772 | A * | 6/1950 | Finzie | 439/11 |
| 3,474,376 | A * | 10/1969 | Preiss | 439/31 |
| 4,857,702 | A * | 8/1989 | Cafaro | 219/225 |
| 4,997,381 | A * | 3/1991 | Oh | 439/172 |
| 5,160,879 | A * | 11/1992 | Tortola et al. | 320/111 |
| 5,220,152 | A * | 6/1993 | Doran | 219/201 |
| 5,249,970 | A * | 10/1993 | Jennings | 439/31 |
| 5,401,178 | A * | 3/1995 | Liu | 439/131 |
| 5,658,152 | A * | 8/1997 | Selker | 439/31 |
| 5,692,921 | A * | 12/1997 | Jennings | 439/346 |
| 5,772,447 | A * | 6/1998 | Cheung | 439/31 |
| 5,997,310 | A * | 12/1999 | Chiu et al. | 439/21 |
| 6,325,646 | B1 * | 12/2001 | Uemura et al. | 439/131 |
| 6,398,566 | B1 * | 6/2002 | Chen | 439/131 |
| 6,494,727 | B2 * | 12/2002 | Wen-Ching | 439/131 |
| 6,544,075 | B1 * | 4/2003 | Liao | 439/638 |
| 6,663,396 | B1 * | 12/2003 | Wang | 439/31 |
| 6,695,620 | B1 * | 2/2004 | Huang | 439/11 |
| 6,786,734 | B2 * | 9/2004 | Yu | 439/11 |
| 6,991,469 | B1 * | 1/2006 | Wang | 439/31 |
| 7,001,196 | B1 * | 2/2006 | Huang | 439/320 |
| 7,104,813 | B1 * | 9/2006 | Chuang | 439/131 |
| 7,125,266 | B1 * | 10/2006 | Huang | 439/131 |
| 7,234,963 | B1 * | 6/2007 | Huang | 439/446 |
| 7,247,028 | B2 * | 7/2007 | Schriefer | 439/11 |
| 7,287,991 | B1 * | 10/2007 | Li | 439/131 |
| 7,484,972 | B1 * | 2/2009 | Kuo et al. | 439/131 |
| 7,549,877 | B1 * | 6/2009 | Vista et al. | 439/172 |
| 7,566,223 | B2 * | 7/2009 | Wadsworth | 439/21 |
| 7,575,436 | B1 * | 8/2009 | Devlin et al. | 439/21 |
| 7,614,903 | B1 * | 11/2009 | Huang | 439/446 |
| 7,810,985 | B2 * | 10/2010 | Chien | 362/641 |
| 7,811,136 | B1 * | 10/2010 | Hsieh et al. | 439/640 |

(Continued)

*Primary Examiner* — Ross Gushi
(74) *Attorney, Agent, or Firm* — Rosenberg, Klein & Lee

(57) ABSTRACT

A rotating plug connected to a power supply of an electric appliance and having a conductive terminal with bending and rotating functions includes an inner frame, two conductive terminals, two inner frame brackets, two connecting plates, two inner frame casings, a power cable and a plug body. A connecting end at the rear of each of the two conductive terminals of the rotating plug is installed and hidden in the inner frame, and the connecting plate is accommodated and fixed inside the inner frame casing. When use, the plug is bent and rotated upwardly or downwardly by an angle, while the conductive terminal and the connecting plate are being covered without being exposed, so as to improve the safety of the rotating plug.

1 Claim, 9 Drawing Sheets

(56) References Cited

U.S. PATENT DOCUMENTS

| | | | | |
|---|---|---|---|---|
| 7,815,471 | B2 * | 10/2010 | Wu | 439/640 |
| 7,824,186 | B2 * | 11/2010 | Zhao et al. | 439/13 |
| 7,828,555 | B1 * | 11/2010 | Huang | 439/6 |
| 7,946,852 | B2 * | 5/2011 | John | 439/21 |
| 8,123,528 | B2 * | 2/2012 | Devlin et al. | 439/21 |
| 8,157,569 | B1 * | 4/2012 | Liu | 439/11 |
| 8,371,872 | B2 * | 2/2013 | Zhou | 439/446 |
| 8,651,874 | B2 * | 2/2014 | Ku et al. | 439/31 |
| 8,777,671 | B2 * | 7/2014 | Huang | 439/640 |
| 2002/0137387 | A1 * | 9/2002 | Lin | 439/446 |
| 2004/0023520 | A1 * | 2/2004 | Schriefer | 439/11 |
| 2004/0048494 | A1 * | 3/2004 | Yu | 439/11 |
| 2005/0287827 | A1 * | 12/2005 | Liao | 439/11 |
| 2006/0246742 | A1 * | 11/2006 | Sun | 439/11 |
| 2008/0227338 | A1 * | 9/2008 | Lin et al. | 439/640 |
| 2008/0261430 | A1 * | 10/2008 | Wadsworth | 439/295 |
| 2009/0093163 | A1 * | 4/2009 | Tsai | 439/620.21 |
| 2010/0029095 | A1 * | 2/2010 | Wu | 439/31 |
| 2010/0029096 | A1 * | 2/2010 | Wu | 439/31 |
| 2010/0130026 | A1 * | 5/2010 | Honda | 439/21 |
| 2013/0040479 | A1 * | 2/2013 | Hsu | 439/171 |
| 2013/0301283 | A1 * | 11/2013 | Ng et al. | 362/427 |
| 2014/0127937 | A1 * | 5/2014 | Huang | 439/534 |
| 2014/0235079 | A1 * | 8/2014 | Wallace | 439/131 |

* cited by examiner

ROTATING PLUG

FIELD OF THE INVENTION

The present invention relates to a rotating plug, and more particularly to the rotating plug connected to a power supply of an electric appliance and having a conductive terminal with bending and rotating functions.

BACKGROUND OF THE INVENTION

In general, a conventional plug is mainly used for connecting various different power supplies of electric appliances. Since the types of electric appliances become increasingly more, and the use of plugs also becomes more frequently, and manufacturers try to improve the plug structure continuously to provide better functions and effects of the plugs. In present existing plugs, some come with bending and rotating functions, so that users can connect and use the plugs more conveniently by bending and rotating the plug as needed.

With reference to FIGS. 1, 2 and 3 for the structure of a conventional rotating plug, the rotating plug comprises an inner frame 10, a main body 11, two conductive terminals 12 and a power cable 13, wherein two conductive terminals 12 are protruded from a front end of the inner frame 10, and a power cable 13 is connected to the rear of the main body 11, and the inner frame 10 is passed and installed to the center of the main body 11, so that the two conductive terminals 12 is connected to the power cable 13 in the main body 11, and the inner frame 10 and the main body 11 are axially connected and combined to form the conventional rotating plug.

However, the aforementioned conventional plug has a small gap 14 formed at the joint position of the inner frame 10 and the main body 11, such that the conductive terminal 12 is exposed. If the plug is bent and rotated, then the conductive terminal 12 will be exposed from the small gap 14 more obviously, thus causing a serious problem on the safety of use.

In view of the aforementioned shortcoming of the conventional product, the inventor of the present invention based on years of experience in the related industry to conduct extensive researches and experiments, and finally designed and developed a novel practical rotating plug to overcome the shortcoming of the prior art.

SUMMARY OF THE INVENTION

Therefore, it is a primary objective of the present invention to provide a rotating plug with conductive terminals completely covered and hidden inside an inner frame and a main body. When the plug is bent and rotated, the conductive terminals will not be exposed, so as to enhance the safety and practical use.

To achieve the aforementioned objective, the present invention provides a rotating plug, comprising: an inner frame, two conductive terminals, two inner frame brackets, two connecting plates, two inner frame casings, a power cable and a plug body, wherein the two conductive terminals are pivotally, axially, and respectively coupled to the two connecting plates by a rivet and a gasket, so that the conductive terminals are passed from both internal sides of the inner frame and protruded out from the inner frame, and then the connecting plate is bent and rotated by 90 degrees to latch the inner frame bracket into an arc latch slot at the rear of the inner frame, and the connecting plate is bent and rotated upwardly by 90 degrees to resume its original horizontal status, and inner frame casings are used for connecting, laching and fixing the top and bottom of the two connecting plates respectively, and then a power cable is soldered to a rear end of each connecting plate, and an insulative external protective layer is coated onto the exterior of the inner frame casing by plastic injection molding to form the plug body, and the aforementioned components are assembled into the overall structure of the rotating plug.

In summation, the present invention has the following effects: The connecting ends at the rear section of the two conductive terminals of the present invention are passed, installed and hidden inside the inner frame, and the connecting plate is accommodated and fixed into the inner frame casing, so that when the present invention is in use, the plug can be bent and rotated to an angle, and the conductive terminals and connecting plates will not be exposed, so as to improve the safety of the product.

DESCRIPTION OF THE PREFERRED EMBODIMENTS

The technical characteristics, contents, advantages and effects of the present invention will be apparent with the detailed description of a preferred embodiment accompanied with related drawings as follows.

Figure 1:
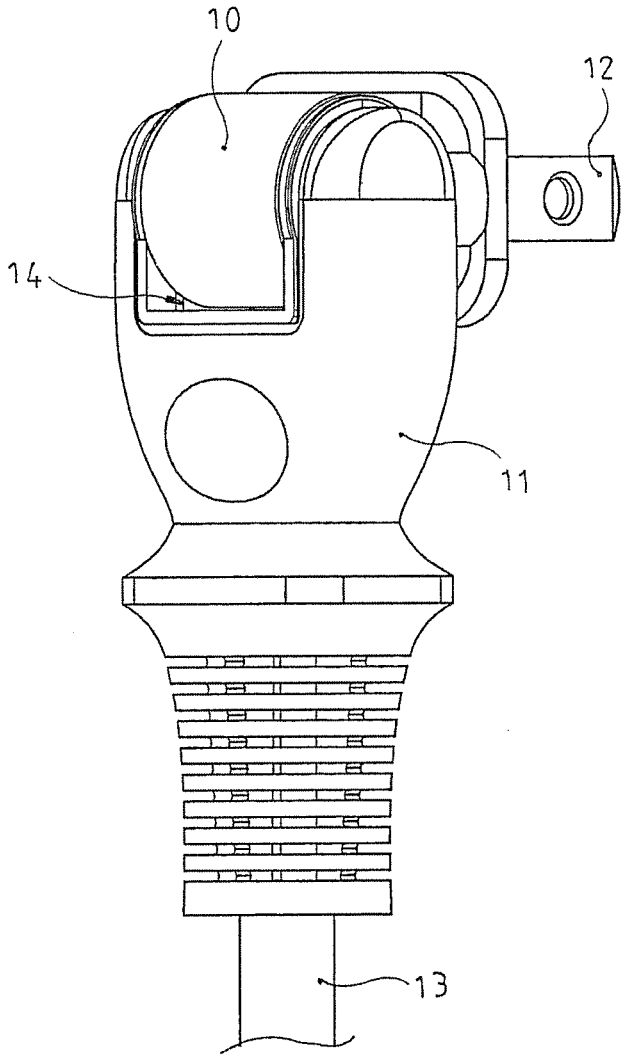
FIG. 1 (PRIOR ART)
FIG. 1 is a perspective view of a conventional product.
Figure 2:
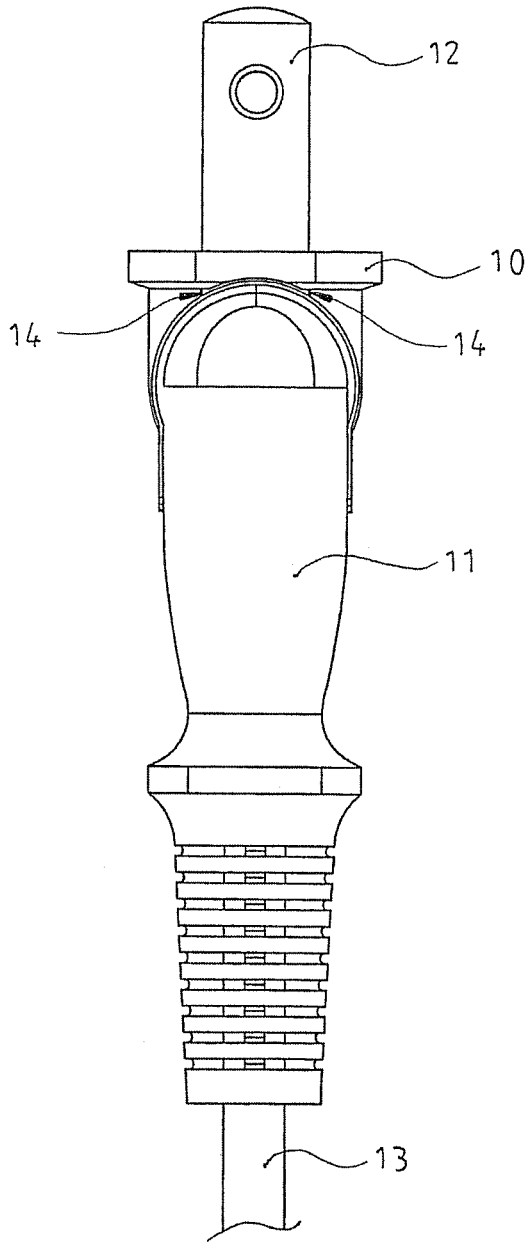
FIG. 2 (PRIOR ART)
FIG. 2 is a side view of a conventional product.
Figure 3:
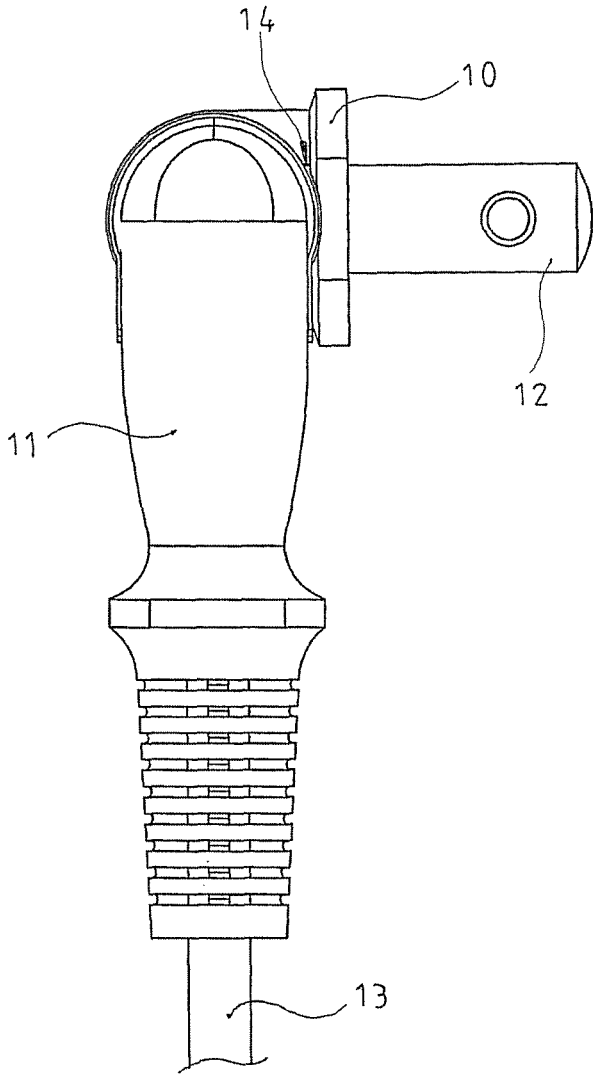
FIG. 3 (PRIOR ART)
FIG. 3 is a side view of a conventional product being bent and rotated by 90 degrees.
Figure 4:
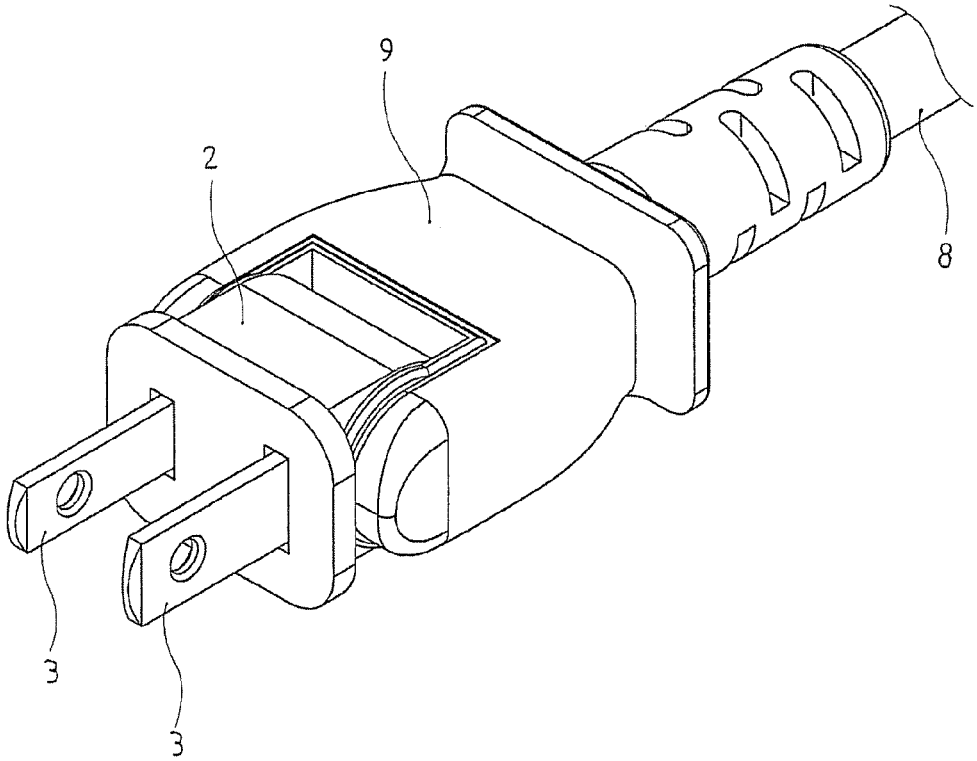
FIG. 4 is a perspective view of the present invention.
Figure 5:
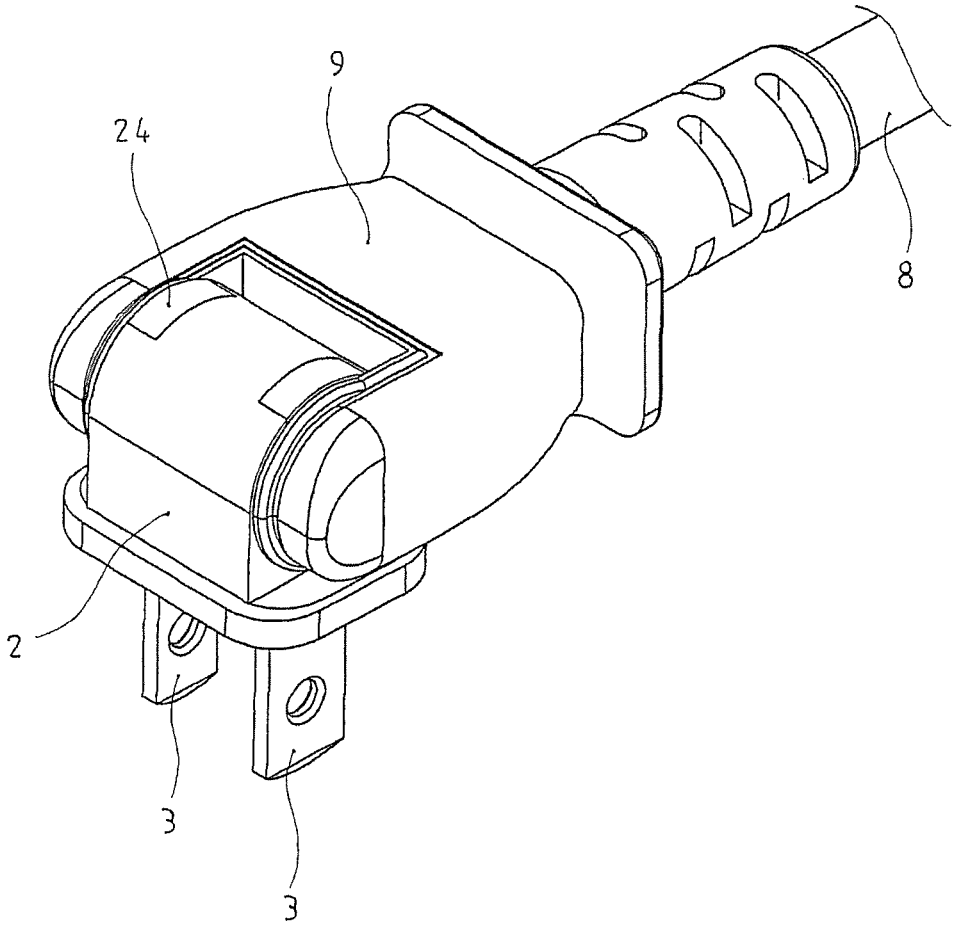
FIG. 5 is a perspective view of the present invention being bent and rotated by 90 degrees.
Figure 6:
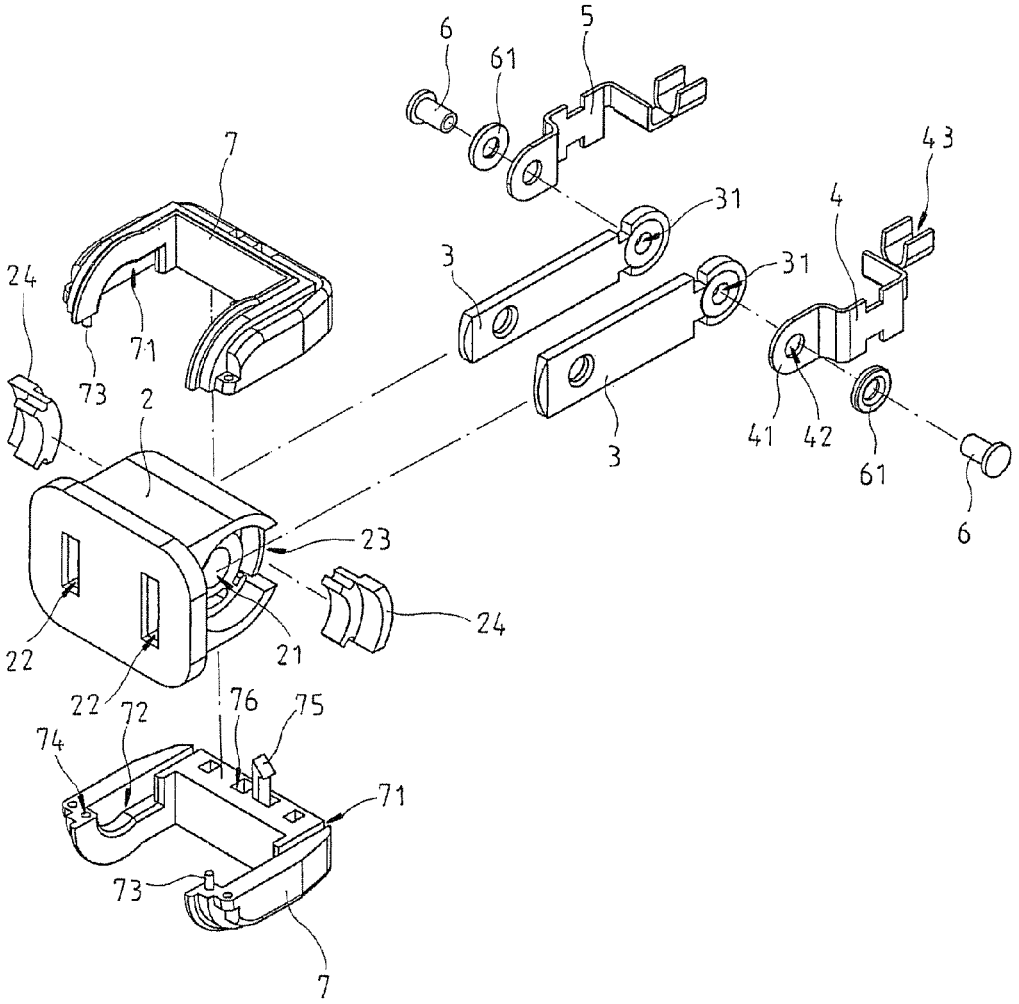
FIG. 6 is an exploded view of the present invention.
Figure 7:
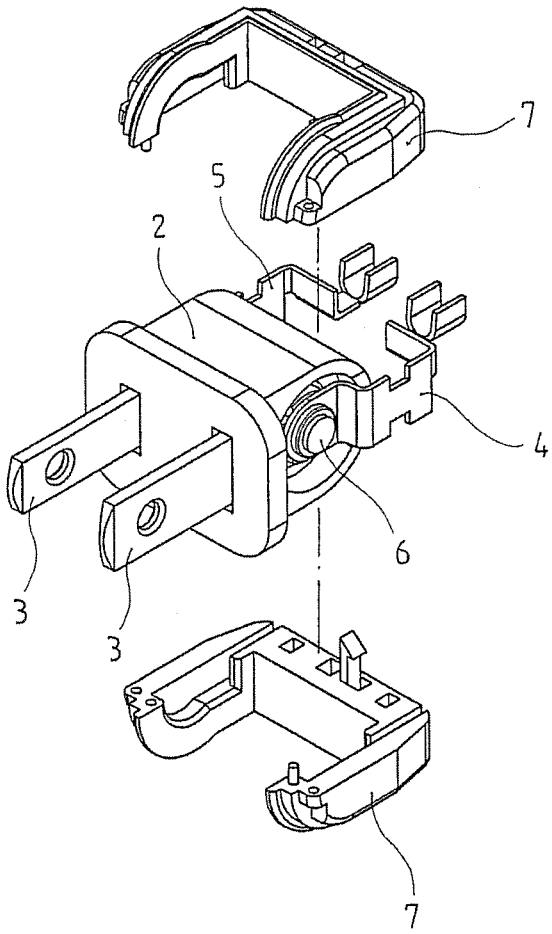
FIGS. 7, 8 and 9 are schematic views of latching the inner frame casings 7 with one another in accordance with the present invention.

With reference to FIGS. 4 to 6 for a rotating plug of the present invention, the rotating plug comprises an inner frame 2, two conductive terminals 3, two inner frame brackets 24, two connecting plates 4, 5, two inner frame casings 7, a power cable 8 and a plug body 9.

In FIG. 6, the inner frame 2 is made of an insulating material and has a circular hole 21 transversally penetrating through the center of the inner frame 2, a slender rectangular slot hole 22 formed at a front edge of both sides of the inner frame, and an arc latch slot 23 concavely formed on each of both sides of a rear edge of the inner frame.

In FIG. 6, the two conductive terminals 3 are made of a metal material of good conductivity and has a circular hole 31 formed at the center of a rear end of each conductive terminal.

In FIG. 6, the two inner frame brackets 24 are made of an insulating material and each inner frame bracket 24 is an arch latching bracket.

In FIG. 6, the two connecting plates 4, 5 are made of a metal material of good conductivity, and has a contact plate 41 disposed at a front end of the connecting plate 4, a circular hole 42 formed at the center of the contact plate 41, and a slot seat 43 having an opening facing upward and disposed at a rear end of the connecting plate e 4.

The connecting plate 5 and the connecting plate 4 are installed symmetrically with respect to each other.

In FIG. 6, the two inner frame casings 7 are made of an insulating material, and the inner frame casing 7 has a fixing slot 71, 72 concavely formed on both internal sides of each inner frame casing 7, a small circular column 73 protruded from a front end of a side of each inner frame casing 7, a small circular hole 74 concavely formed at a front end of the other side of the inner frame casing 7, a latch hook 75 protruded from the rear of the inner frame casing 7, and a rectangular latch slot 76 formed on a side of the latch hook 75.

In FIGS. 6 to 10, a gasket 61 is passed and installed to the connecting plate 4 by a rivet 6, and then the rivet 6 is passed and installed into the circular hole 42 of the connecting plate 4 and the circular hole 31 at the rear end of the conductive terminal 3 and riveted, axially connected and fixed, so that the conductive terminal 3 can be passed and installed into the slot hole 22 at the front edge of the inner frame 2, and then the connecting plate 4 is bent and rotated downwardly by 90 degrees to accommodate and fix the inner frame bracket 24 into the arc latch slot 23 formed on both sides at the rear edge of the inner frame 2, and then the connecting plate 4 is bent and rotated upwardly by 90 degrees to resume its original position, and the tops and bottoms of the two inner frame casings 7 are connected respectively, and the small circular column 73 is protruded from a front end on a side of the two inner frame casings 7 and plugged into a small circular hole 74 of the corresponding other inner frame casing 7. In addition, the latch hook 75 protruded from the rear of the inner frame casing 7 is inserted and latched into the latch slot 76 of the corresponding other inner frame casing 7. In the meantime, the two connecting plates 4, 5 are covered completely between the fixing slots 71, 72 concavely formed on both internal sides of the inner frame casing 7. In addition, the power cable 8 is soldered to the slot seat 43 at a rear end of the connecting plate 4, and the connecting plate 5 and the connecting plate 4 are installed and arranged symmetrically to one another.

Figure 10:
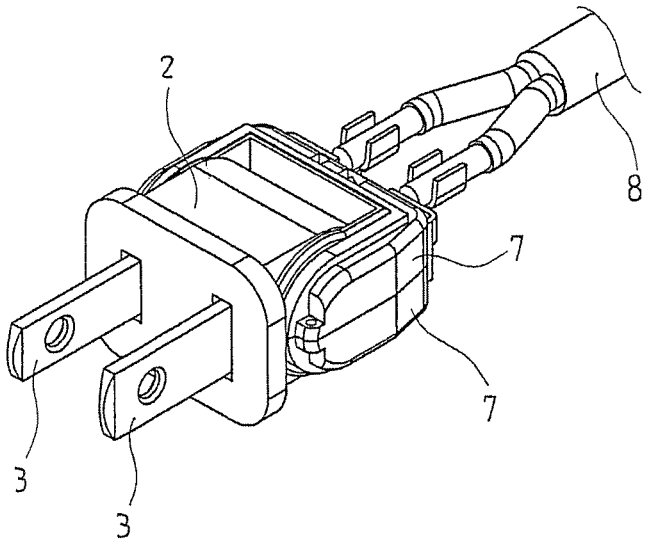
FIG. 10 is a schematic perspective view of the present invention connected to a power cable 8.

In FIGS. 4 and 10, the plug body 9 has an insulating protective layer coated onto the exterior of the inner frame casing 7 and the power cable 8 by injection molding, and the plug body 9 is assembled into the whole rotating plug.

Figure 8:
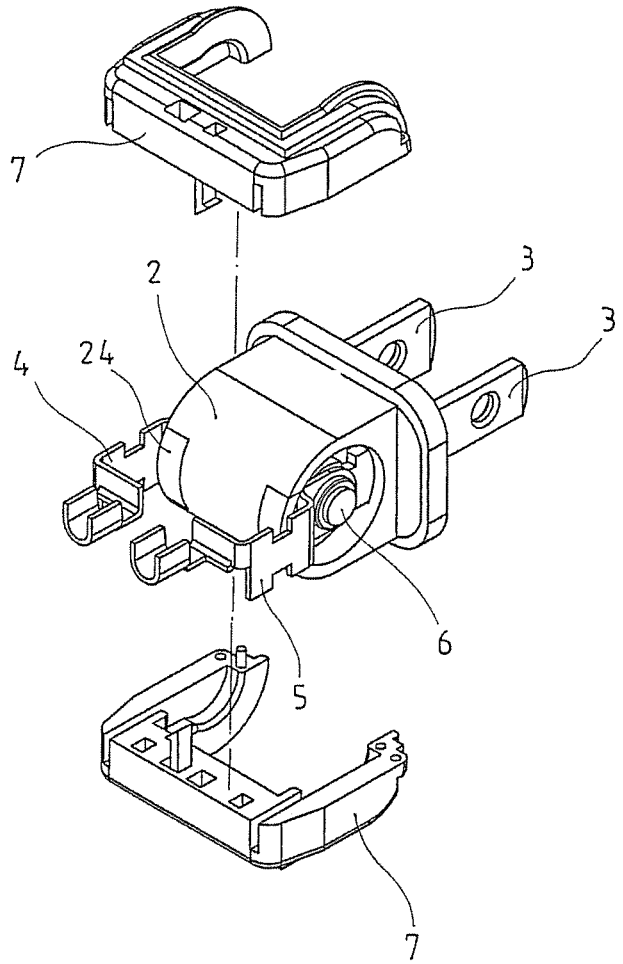
Figure 9:
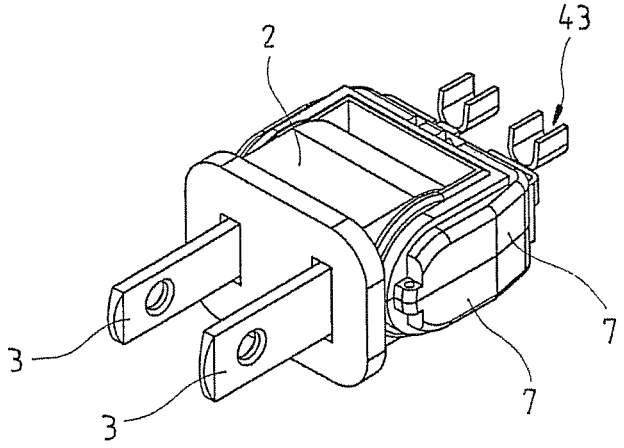

In the overall structure of the present invention with the aforementioned components, the connecting ends at the rear sections of two conductive terminals are passed and hidden inside the inner frame. In FIG. 8, the plug is bent and rotated upwardly or downwardly, and the conductive terminal and the connecting plate are completely covered without being exposed during the use of the present invention, so that the invention can improve the safety and the practical use of the product.

While the invention is described in some detail hereinbelow with reference to certain illustrated embodiments, it is to be understood that there is no intent to limit it to those embodiments. On the contrary, the aim is to cover all modifications, alternatives and equivalents falling within the spirit and scope of the invention as defined by the appended claims.

In summation of the above description, the present invention herein enhances the performance than the conventional structure and further complies with the patent application requirements and is submitted to the Patent and Trademark Office for review and granting of the commensurate patent rights.

What is claimed is:

1. A rotating plug, comprising:

an inner frame, made of an insulating material, and having a circular hole transversally penetrating through the center of the inner frame, a slender rectangular slot hole formed at a front edge of both sides of the inner frame, and an arc latch slot concavely formed on each of both sides of a rear edge of the inner frame;

two conductive terminals, made of a metal material of good conductivity, and having a circular hole formed at the center of a rear end of each conductive terminal;

two inner frame brackets, made of an insulating material, and each being an arc latching bracket;

two connecting plates, made of a metal material of good conductivity, and having a contact plate disposed at a front end of the contact plate, a circular hole formed at the center of each connecting plate, and a slot seat having an opening facing upward and disposed at a rear end of the connecting plate;

two inner frame casings, made of an insulating material, and having a fixing slot concavely formed on both internal sides of each inner frame casing, a small circular column protruded from a front end of a side of each inner frame casing, a small circular hole concavely formed at a front end of the other side of the inner frame casing, a latch hook protruded from the rear of the inner frame casing, and a rectangular latch slot formed on a side of the latch hook; wherein a gasket is passed and installed to the connecting plate by a rivet, and then the rivet is passed and installed into the circular hole of the connecting plate and the circular hole at the rear end of the conductive terminal and riveted, axially connected and fixed, such that the conductive terminal is passed into the slot hole at the front edge of the inner frame, and then the connecting plate is bent and rotated downwardly by 90 degrees to accommodate and fix the inner frame bracket into the arc latch slots on both side at the rear edge of the inner frame, and then the connecting plate is bent and rotated upwardly by 90 degrees to resume its original position, and the tops and bottoms of the two inner frame casings are connected respectively, and a small circular column is protruded from a front end of a side of the two inner frame casings and plugged into the corresponding small circular hole of the other inner frame casing, and a latch hook is protruded from the rear of the inner frame casing and inserted into the latch slot of the corresponding other inner frame casing, while the two connecting plates are being covered and accommodated completely between the fixing slots concavely formed on both inner sides of the inner frame casing, and a power cable is soldered to the slot seat at the rear of each connecting plate, and a plug body, having an insulating protective layer covered onto the exterior of the inner frame casing and the power cable by injection molding, and the plug body being assembled into the whole rotating plug.

* * * * *